United States Patent [19]

Metcalfe et al.

[11] 4,297,406

[45] Oct. 27, 1981

[54] PRODUCT FOR TREATING FABRIC

[75] Inventors: John L. Metcalfe, Wirral; Douglas Wraige, Newton, both of England

[73] Assignee: Lever Brothers Company, New York, N.Y.

[21] Appl. No.: 8,650

[22] Filed: Feb. 1, 1979

Related U.S. Application Data

[63] Continuation of Ser. No. 842,827, Oct. 17, 1977, abandoned, which is a continuation of Ser. No. 782,191, Mar. 28, 1977, abandoned.

[30] Foreign Application Priority Data

Mar. 30, 1976 [GB] United Kingdom ..... 12832/76

[51] Int. Cl.[3] ..... B32B 7/02; B32B 3/26

[52] U.S. Cl. ..... 428/215; 427/242; 427/244; 428/305; 428/311

[58] Field of Search ..... 427/242, 244; 428/310, 428/311, 315, 305, 304, 215, 213

[56] References Cited

U.S. PATENT DOCUMENTS

| | | | |
|---|---|---|---|
| 3,676,199 | 7/1972 | Hewitt et al. | 428/315 |
| 3,686,025 | 8/1972 | Morton et al. | 428/274 |
| 3,696,034 | 10/1972 | Hewitt et al. | 428/242 |
| 3,720,574 | 3/1973 | Kunc | 428/315 |
| 3,743,534 | 7/1973 | Zamora | 427/242 |
| 3,895,128 | 7/1975 | Gaiser | 428/279 |
| 3,947,971 | 4/1976 | Bauer | 427/242 |
| 3,949,137 | 4/1976 | Akrongold et al. | 428/311 |
| 3,978,855 | 9/1976 | McRae et al. | 428/311 |
| 4,057,673 | 11/1977 | Falivene | 427/242 |
| 4,070,520 | 1/1978 | Volz et al. | 428/311 |
| 4,086,387 | 4/1978 | Triolo | 428/311 |
| 4,105,813 | 8/1978 | Mizuno | 427/242 |
| 4,170,565 | 10/1979 | Flesher et al. | 428/304 |
| 4,254,139 | 3/1981 | Hendrickson et al. | 428/311 |

*Primary Examiner*—William J. Van Balen

*Attorney, Agent, or Firm*—Irving N. Feit; James J. Farrell; Melvin H. Kurtz

[57] ABSTRACT

After washing fabrics can be treated with a conditioning agent, for example a fabric softener. In one method of treatment a substrate impregnated with a conditioning agent is contacted with the washed fabrics in tumble drier. The agent is transferred to the fabric during the repeated contacts between the substrate and fabric.

The invention is the use of a substrate having a more dense structure at the outer surface. This more dense structure, which can be formed from laminated foam polymers, reduces the release of the agent so that the release is more even over a number of cycles.

9 Claims, No Drawings

PRODUCT FOR TREATING FABRIC

This is a continuation, of application Ser. No. 842,827, filed Oct. 17, 1977 which in turn is a continuation of application Ser. No. 782,191 filed Mar. 28, 1977, both abandoned.

This invention relates to a product for the treatment of fabrics with conditioning agents. The products are particularly adapted for use in tumble drying machines, that is to say machines in which damp fabrics are tumbled whilst warm arm is passed around them so to remove the moisture.

The practice of washing cloths and fabrics has been found to have a harshening effect on the feel of the fabrics during subsequent wear of usage, especially in the case of cotton fabrics such as towelling. It has therefore been proposed to soften the fabrics by treating them with fabric softening agents in tumble driers. For example, it has been proposed to spray a fabric softening agent on the inside of the drum of a tumble drier before putting the fabrics into the tumble drier, so that the fabric softening agent is rubbed off the drum onto the fabrics during the tumble drying; but this can lead to the build-up of a sticky residue on the drum. It has also been proposed to impregnate a piece of fabric with a softening agent and then to add it to the tumble drier with the clothes to be softened, so that the softening agent is transferred from the fabric to the clothes during tumble drying; but this is inconvenient as a new impregnated fabric piece usually needs to be used each time and it is relatively expensive. Moreover, a relatively high proportion of the softening agent tends to be retained on the original impregnated fabric.

According to the present invention, we have devised an improved product for the treatment of fabric in tumble driers. In its broadest aspect, the present invention provides a product adapted for treating fabric in a tumble drier, which product comprises a substrate impregnated with a fabric conditioning agent, wherein the substrate has a more dense structure at its outer surface or surfaces than internally. Construction of the products in this manner provides more economical application of fabric conditioning agents to treated fabrics during use of the products. In particular, it is thought that the less dense internal structure provides a reservoir for fabric conditioning agents, which migrates to the surface during use due to the capillary action caused by the finer, ie more dense substrate structure by the surface. This means that more fabric conditioning agent is discharged from the products during use and facilitates the construction of multi-use products. It is also possible to alleviate the problem of the substrate sticking to the sides of the tumble drier or blocking the tumble drier outlet as can happen with single thin impregnated sheets.

By using a product of the invention it is possible to obtain substantially uniform distribution of the fabric conditioning agent over the fabrics to be treated, and by adjustment of the amount of the fabric conditioning agent in the products it is possible to use them for more than one tumble drying operation.

Products according to the present invention may take a variety of physical forms, though each still embodies the essential feature of being formed of impregnated substrate of varied density of structure. The preferred substrate is foamed plastic or rubber, which is preferably highly porous and very flexible. Suitable solid foam is of the open-cell type, as closed-cell foams are not sufficiently porous, preferably with an external density of about 20–30 kg/m$^3$ and an external pore count (cells per inch) of about 30–70 (ie about 10–30 cells per cm). The internal structure of the substrate has a lower density than the external structure, preferably about 10–25 kg/m$^3$, and an internal pore count of about 5–50 cells per inch (2–20 per cm). Such plastic or rubber foam is preferably in sheet form having an overall thickness of from about 0.2 cms to about 2.5 cm, for example from about 0.5 cm to about 2 cms. The external layer will have a thickness in the range from about 0.5 mm to about 4 mm, preferably from about 1 to about 2.5 mm.

The substrates are preferably formed by laminating plastic foam sheets together, that is with an internal sheet of foam of low density and two external sheets of higher density. Lamination may be accomplished, for example, by heating the sheets and thereby melting the surfaces before pressing them together or by using adhesives. Alternatively, single sheets may be treated to alter their surface structures to increase the density there, for example by causing localised heat-shrinkage. Besides being in sheet form, the substrates may take ball, block, strip or other shapes, provided they have the less dense internal structure as specified above.

Specific preferred substrates which may be mentioned are formed of polyurethane foams which are obtainable in sheet form. We have found that polyurethane foams of polyether type are better than those of polyester type for form retention at the elevated temperatures encountered during tumble drying. The foam plastic used may be a reticulated foam if desired, that is a foam in which the cell walls are ruptured but leaving the overall cell network intact. Rupturing of the cell walls provide a passage through the material for liquid or gas.

Alternatively, the substrate may be a fabric, of either woven or non-woven construction, but the fabric should be constructed or treated to have a less dense internal structure than at its surface. For example the fabric may be coated or laminated with a rubber or plastic foam material.

The products of the invention are particularly suitable or free-tumbling with fabrics in tumble driers, but it is also possible to attach products to the interior surfaces of the tumble driers, either by pressure sensitive adhesives or by other means, for example mateable woven hook and loop fastenings, eg of the "Velcro" (trademark) type or by tapes or hooks. The products may also carry loops or tapes for conveniently carrying the products or for handing them between their use.

It will be appreciated that the products of the invention may be coloured or they may carry patterns or writing, for example instructions on how to use the product. The products may also be designed for alternative use after they have been used for fabric treatment, for example as a bath sponge, upholstery-cleaning or car-washing sponge.

As described above, the product contains a fabric conditioning agent which is impregnated into the substrate. Preferably the conditioning agent is solid at room temperature but melts or softens at a temperature reached during the treatment of the fabric, usually in the region of about 38° C. to about 80° C. in normal tumble drying operations. The conditioning agent can then be more readily transferred to the fabric during use, and progressive migration of the conditioning agent from the inner parts of the product to its outer surface is facilitated. Alternatively, the conditioning agent may be a viscous liquid or pasty material, but this is not desirable due to the sticky nature of the product and the relatively low levels of the conditioning agent which can consequently be used.

As described above, the product of the invention is employed to treat fabric with conditioning agents during tumble drying. The preferred conditioning agents are so-called softening agents which make the treated fabrics feel softer to the touch. Many fabric softening agents are quaternary ammonium compounds, having the general formula:

$$[N^+(R_1R_2R_3R_4)]_n, X^- \quad (I)$$

wherein $R_1$ is a $C_{16}$ to $C_{22}$ alkyl group, $R_2$ is a $C_1$ to $C_4$ alkyl group and $R_3$ and $R_4$ are the same as $R_1$ or $R_2$, and any of $R_1$, $R_2$, $R_3$ and $R_4$ may be saturated or unsaturated, linear or branched chain alkyl groups, or they may contain substituent groups, eg hydroxy groups, or $R_1$, $R_2$, $R_3$ and $R_4$ may be connected to the nitrogen atoms with linking groups, eg amide, ester or ether linkages, or 2 or 3 of $R_1$, $R_3$ and $R_4$ may be conjoined with the N atom to form a heterocyclic ring such as a morpholinyl ring, X is an anion and n is the valency of X. Suitable anions ($X^-$) are $Cl^-$, $HSO_4^-$, $SO_4^{--}$, $C_2H_5SO_4^-$, $CH_3SO_4^-$, $HCOO^-$, $CH_3COO^-$, $Br^-$, $I^-$ and $H_2PO_4^-$, of which the chloride, sulphate, bromide and acetate ions are preferred. Typical commercial products of this type are di-tallow-dimethyl ammonium chloride, dicoco-dimethyl ammonium chloride, di(-stearoyloxyethyl)dimethyl ammonium chloride and 3-behenoyloxy-2-hydroxypropyl trimethyl ammonium chloride.

Other preferred softening agents are the reaction products of about 2 moles of a fatty acid of the formula $R_4COOH$ and a hydroxyalkyldiamine of the formula:

$$NH_2—R_5—NHR_6 \quad (II)$$

wherein $R_4$ is a $C_{15}$ to $C_{19}$ alkyl group, $R_5$ is a $C_1$ to $C_3$ divalent hydrocarbon group and $R_6$ is a hydroxyalkyl group containing 1 to 3 carbon atoms. A typical commercial product of this type is the reaction product of 2 moles of stearic acid with 1 mole of hydroxyethyl ethylene diamine, which has a mixed chemical structure because of the multifunctional nature of the diamine. Similar products include the quaternised products of about 2 moles of oleic acid reacted with 1 mole of hydroxyethyl ethylene diamaine and the product of about 2 moles of a mixture of oleic and stearic acids reacted with 1 mole of hydroxyethyl ethylene diamine. The softening agents are preferably used in admixture with a nonionic surfactant.

Other types of fabric softening agents which may be used in the present invention are known in the art and described in the literature, for example in "Proceedings of the American Association of Textile Chemists and Colorists", American Dyestuff Reporter, pages P42 and P43, January 28, 1957.

Other fabric conditioning agents which can be employed in the products of the invention, either alone or in admixture, especially in admixture with fabric softening agents as described above include:

(1) Optical brighteners, ie fluorescent brightening agents such as substituted disulphonated diaminostilbene compounds for example as disclosed in U.S. Pat. No. 2,612,501, and triazole compounds of the type disclosed in U.S. Pat. No. 2,784,183.

(2) Essential oils and fragrances.

(3) Antistatic agents, which in many cases are compounds of the same general structures discussed above with respect to fabric softening compounds. Specific antistatic agents which may be mentioned by way of example are ethoxylated compounds such as ethoxylated amines, ethoxylated quaternary ammonium compounds, ethoxylated aliphatic alcohols or alkyl phenols, ethoxylated carbohydrates such as sorbitol ethoxylates, ethoxylated aliphatic mono- or di-carboxylic acids, amides or esters thereof, or polyethylene glycols, the antistatic properties of the preferred quaternary ammonium compounds as well as other fabric softening agents may be enhanced in particular by combining these materials with ethoxylated amides such as tallow ethanolamides, or with ethoxylated aliphatic alcohols.

(4) germicides, such as the halogenated salicylanilides, eg tribromosalicylanilide, hexachlorophene, neomycin sulphate, benzalkanium quaternary compounds, and the like.

(5) Bodying agents, such as carboxymethylcellulose, hydroxyethylcellulose, starch, polyvinyl acetate and the like. Polyvinyl acetate is also effective to improve ease of ironing and may be employed for that purpose.

(6) Soil release agents, such as the polyacrylic polyvinyl alcohol compositions described, for example, in U.S. Pat. No. 3,377,249, and fluorocarbons, or copolymers of ethylene glycol with terephthalic acid which are useful for treating polyester fabrics for this purpose.

(7) Ironing aids, for example silicones such as dimethyl silicone.

(8) Surface active agents, used in admixture with other conditioning agents, for example nonionic surfactants used with quaternary ammonium fabric softening agents. In this case it is preferred to have a ratio of the cationic quaternary ammonium compound to the nonionic compound of about 2:1 to about 20:1, especially about 3:1 to about 10:1, parts by weight.

It will be appreciated that several of the conditioning agents described above are normally solid non-meltable materials, is at elevated as well as at room temperatures in which case they should be employed either in aqueous solution or dispersion, or with other conditioning agents which are liqquid or meltable solids. When the conditioning agents are impregnated into the substrate they should be in liquid form, either due to melting or due to the presence of a solvent which can subsequently be evaporated.

The amount of the fabric conditioning agent used in a product of the invention depends of course on the type of the agent and the type of product, especially if multiple use of the product is intended, and the optimum levels can readily be determined. For example, in the case of a fabric softening agent, it is normally preferred to have about 1 gram to about 5 grams, preferably about 2 to 4 grams, of softening agent available for application to a typical domestic fabric load in a tumble drier. Products intended for multiple use should contain proportionately more fabric conditioning agent. As all of the fabric conditioning agent is not discharged from the product, it is generally preferred to have a total amount of about 25 grams to about 50 grams of fabric conditioner in the product intended for multiple use, usually over about 5 to 10 dryer cycles. In general an amount of about 0.1 gram of fabric conditioner per $cm^3$ of plastic foam is found to be suitable for optimum discharge from the product.

It is possible to use more than one product at a time in a tumble drying machine so as to secure sequential release of fabric conditioning agents during the drying cycle, for example by using softening agents which melt at different temperatures, or for the simultaneous treatment of different types of fabrics. It may for eample be particularly advantageous to secure the release towards the end of the fabric treatment of certain conditioning agents such as germicides or perfumes, especially if they interfere with or are inhibited by other fabric conditioning agents.

The invention is illustrated by the following examples in which parts and percentages are by weight except where otherwise indicated.

EXAMPLE 1

A laminated polyurethane foam sheet was made by bonding an inner layer (6 mm) of reticulated foam of large pore size (35–45 pores per inch) between two outer layers (1 mm) of foam of smaller pore size (45–55 pores per inch). An 11"×9" a mixture of 80 parts by weight of 3-alkyloxy-2-hydroxypropyl trimethyl ammonium chloride (the alkyl group was derived from rape seed oil and contained about 64% $C_{22}$, about 22% $C_{18}$ and about 12% $C_{20}$ alkyl groups) and 20 parts by weight of secondary-linear $C_{11}$–$C_{15}$–12 EO condensate. Fabric was then treated in five successive tumble drier cycles, and in each case the softening effect was readily noticeable compared with untreated fabrics.

A further test was undertaken using a different fabric softening composition, particularly a mixture of 80 parts of di-hardened-tallow-dimethyl ammonium chloride and 20 parts by weight of secondary-linear $C_{11}$–$C_{15}$ alcohol–12 EO condensate plus 1 part of perfume with similar good fabric softening results and with an attractive lasting fresh smell being imparted to treated fabric in multiple dryer cycles.

A comparative test was undertaken using a commercially available product with a single thin sheet of foam of uniform density about 20 cms by 7.5 cms, carrying about 2.5 grams of fabric softening agent. It was found that during a normal tumble dryer operation only about 0.5 gram of the fabric softening agent was transferred to the fabric being dried, which was insufficient to give a satisfactory fabric softening effect or any appreciable antistatic properties, and there was no benefit to be achieved on attempted re-use of the product.

EXAMPLE 2

A rectangular piece of the laminated foam sheet described in Example 1, measuring 11"×9" was impregnated with a 15% aqueous dispersion of a copolymer of ethylene glycol and terephthalic acid formed by reacting 2 moles of the former with 1 mole of the latter and then reacting the product with additional polyethylene glycol, obtained as Permalose T (trademark), which was then dried. The resultant product, which contained 30 grams of the anti-soiling aid, was used to treat polyester fabrics in a tumble drier and it was found that satisfactory improved anti-soiling properties were imparted to the treated fabric over 5 successive dryer cycles.

EXAMPLE 3

In another test the laminated sheet of Example 1 was impregnated with 20 grams of a 24:1 mixture by weight of tallow alcohol—50 EO condensate and disodium 4,4'-di(2"-anilino-4"-diethanol-aminotriozin-6"-ylamino)-stilbene-2,2'-disulphonate (obtained as Photine C (trademark)). Cotton sheeting was dried in a tumble drier using this product and it was found to improve in apparent whiteness under artificial lighting, for several tumble drier cycles.

EXAMPLE 4

A sheet of reticulated polyurethane foam of 7 mm thickness and 20 cells/inch was flame-bonded between two sheets of polyurethane foam of 1.5 mm thickness and 48 cells/inch. The final product had an overall thickness of about 7.6 mm. Single sheets of 11"×9" of the laminated foam were impregnated with 23 grams of a mixture of 80 parts of di-hardened-tallow-alkyl-dimethyl ammonium chloride and 20 parts of a condensation product of secondary-linear ($C_{11}$–$C_{15}$) alcohol with 12 moles of ethylene oxide. This product was used to treat fabric in a domestic tumble drier and it was found that the appreciable softening properties were imparted to the fabric over five successive drier cycles using a single impregnated sheet.

EXAMPLE 5

Two samples (A,B) of laminated polyurethane foam sheet were prepared by bonding an inner layer (6 mm.) of reticulated foam between two outer layers (1 mm.) of non-reticulated foam of smaller pore size. A sample C of reticulated foam (6 mms) was used as comparison. To a 11"×9" piece of each sample was added 20 grams of a mixture of 80 parts by weight of di-hardened-tallow-alkyl-dimethyl ammonium chloride with 20 parts of Secondary linear ($C_{11}$–$C_{15}$) alcohol.12 EO condensate. Each sample was then tumbled with a cotton load (1.5 kg) having 75% water content to start. The tubular drier cycle operated from 28° C. to 77° C. for 45 minutes. Each sample was subjected to 5 successive cycles and the delivery of softener active as parts per million (ppm) on the weight of fabric noted. The Table quotes the delivery provided for each sample for each cycle.

TABLE

Pore size is given in pores per inch.

| Sample | Pore size inner layer | Pore size outer layer | Delivery in ppm per cycle 1 | 2 | 3 | 4 | 5 |
|---|---|---|---|---|---|---|---|
| A | 40 | 50 | 1880 | 950 | 698 | 535 | 455 |
| B | 35 to 45 | 45 to 55 | 2292 | 1003 | 571 | 516 | 330 |
| C | 55 | None | 3209 | 743 | 351 | 210 | 290 |

These results demonstrate the presence of outer layers in the laminated samples reduce the initial delivery but improve the delivery in the subsequent use cycles.

What we claim is:

1. A fabric treating product comprising:

(a) a first and second outer layer of resiliently flexible foamed polymer substrate having a relatively dense structure; laminated to;

(b) an inner layer of resiliently flexible foamed polymer substrate having a relatively less dense structure and being positioned between said first and second outer layers; and (c) a fabric conditioning agent impregnated into said inner layer and said first and second outer layers.

2. A fabric treatment product according to claim 1, wherein said first and second outer layers and said inner layer are in sheet form, said first and second outer layers each have a thickness of from about 0.5 mm to about 4 mm and the overall thickness of the product is from about 0.2 cm to about 2.5 cm.

3. A fabric treatment product according to claim 2, wherein said first and second outer layers each have a thickness of from about 1 mm to about 2.5 mm and the overall thickness of the product is from about 0.5 cm to about 2.00 cm.

4. A fabric treatment product according to claim 1, wherein said first and second outer layers each have a pore count of from about 30 to about 70 cells per inch and said inner layer has a pore count of from about 5 to about 50 cells per inch.

5. A fabric treatment product according to claim 1, wherein said fabric conditioning agent comprises a fabric softening agent.

6. A fabric treatment product according to claim 5, wherein the fabric softening agent is a quaternary ammonium compound.

7. A fabric treatment product according to claim 6, wherein the quaternary ammonium compound is admixed with a non-ionic surfactant in a weight ratio of from about 2:1 to about 20:1 by weight.

8. A fabric treatment product according to claim 1, wherein said fabric conditioning agent comprises an anti-static agent.

9. A fabric treatment product according to claim 1, wherein said fabric conditioning agent is a normally solid material which melts at elevated temperatures during tumble drying.

* * * * *